US008349468B2

(12) United States Patent
Masuda et al.

(10) Patent No.: US 8,349,468 B2
(45) Date of Patent: Jan. 8, 2013

(54) METAL MATERIAL FOR PARTS OF CASTING MACHINE, MOLTEN ALUMINUM ALLOY-CONTACT MEMBER

(75) Inventors: Jun Masuda, Mishima (JP); Shuhei Homma, Numazu (JP); Ryousuke Fujimoto, Numazu (JP)

(73) Assignee: Toshiba Kikai Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 12/891,477

(22) Filed: Sep. 27, 2010

(65) Prior Publication Data

US 2011/0014495 A1 Jan. 20, 2011

Related U.S. Application Data

(62) Division of application No. 10/599,118, filed as application No. PCT/JP2005/005100 on Mar. 22, 2005, now Pat. No. 7,829,138.

(30) Foreign Application Priority Data

Mar. 22, 2004 (JP) ..... 2004-082990

(51) Int. Cl.

| | |
|---|---|
| ***B32B 5/16*** | (2006.01) |
| ***B32B 3/02*** | (2006.01) |
| ***B32B 3/14*** | (2006.01) |
| ***B32B 15/16*** | (2006.01) |
| ***B32B 15/18*** | (2006.01) |

(52) U.S. Cl. ..... 428/627; 428/609; 428/678; 428/687; 164/271

(58) Field of Classification Search ..... None
See application file for complete search history.

(56) References Cited

U.S. PATENT DOCUMENTS

| | | | | |
|---|---|---|---|---|
| 3,495,630 | A | 2/1970 | Hansen et al. | |
| 4,197,902 | A * | 4/1980 | Von Jan et al. | 164/418 |
| 4,733,715 | A | 3/1988 | Matsuzaki | |
| 4,868,069 | A | 9/1989 | Darrow | |
| 4,951,888 | A * | 8/1990 | Sharpe et al. | 241/296 |
| 4,995,427 | A | 2/1991 | Berchem | |
| 4,996,114 | A | 2/1991 | Darrow | |
| 2005/0116192 | A1 | 6/2005 | Vincent | |
| 2007/0144627 | A1 | 6/2007 | Masuda et al. | |
| 2007/0196684 | A1 | 8/2007 | Masuda | |

FOREIGN PATENT DOCUMENTS

| | | |
|---|---|---|
| EP | 06 95 998 | 2/1996 |

(Continued)

OTHER PUBLICATIONS

JP 2001-342530 English Machine Translation, Honma et al., Dec. 2001.

(Continued)

*Primary Examiner* — Jennifer McNeil
*Assistant Examiner* — Jason Savage
(74) *Attorney, Agent, or Firm* — DLA Piper LLP (US)

(57) ABSTRACT

A Ni alloy layer is formed on a surface of a steel base on the side to be in direct contact with a molten aluminum alloy, and titanium carbide (TiC) is bonded in a particulate state to the surface of the Ni alloy layer. This makes it possible to provide a metal material having materially enhanced melting loss resistance without resorting to conventional techniques, such as the provision of a ceramic coating by PVD or CVD.

20 Claims, 3 Drawing Sheets

FOREIGN PATENT DOCUMENTS

| | | |
|---|---|---|
| JP | 51-20303 | 2/1976 |
| JP | 03-126681 | 5/1991 |
| JP | 07-001077 | 1/1995 |
| JP | 08/025063 | 1/1996 |
| JP | 08-132215 | 5/1996 |
| JP | 08-229657 | 9/1996 |
| JP | 2000-351054 | 12/2000 |
| JP | 2001-287004 | 10/2001 |
| JP | 2001-300711 | 10/2001 |
| JP | 2001-342530 | 12/2001 |
| JP | 2002-066708 | 3/2002 |
| JP | 2003-170262 | 6/2003 |
| JP | 2005-264306 | 9/2005 |
| KR | 10-1987-11269 | 12/1987 |

OTHER PUBLICATIONS

JP 2001-300711 English Machine Translation, Negishi, Oct. 2001.
JP 08-229657 English Machine Translation, Nakayama et al., Sep. 1996.
JP 76020303, Nippon Tungsten KK, Jun. 1976, Titanium Carbide Cement Scraping Tool Formed as a Nitrided Layer on Steel Substrate, English Abstract from DWPI Database.
International Preliminary Examination Report for PCT/JP05/000510, Jan. 2007.
Notice of Allowance issued in related Korean Parent Application No. 2006-018288, mailed Apr. 4, 2008.
English language abstract of JP 03-126681, published May 29, 1991.
Machine English language translation of JP 08-025063, published Jan. 30, 1996.
English Abstract of JP 08-025063 published Jan. 30, 1996.
Machine English language translation of JP 2001-287004, published Oct. 16, 2001.
English Abstract of JP 2001-287004 published Oct. 16, 2001.
English language abstract of KR 10-1987-0011269, published Dec. 22, 1987.
International Search Report of PCT/JP2007/056048.
English Language Abstract for JP 2005 264306 published Sep. 29, 2005.
English Language translation of JP-2005-264306 published Sep. 29, 2005.
English Language Abstract for JP 2000 351054 published Dec. 19, 2000.
English Language translation of JP-2000-351054 published Dec. 19, 2000.
English Language Abstract for JP 2002 066708 published Mar. 5, 2002.
English Language translation of JP-2002-066708 published Mar. 5, 2002.
English Language Abstract for JP 08-229657 published Sep. 1, 1996.
English Language Abstract for JP 2001-300711 published Oct. 30, 2001.
English Language Abstract for JP 2001-342530 published Dec. 14, 2001.
English language translation of International Preliminary Report on Patentability issued in Application No. PCT/JP07/056048 mailed Nov. 13, 2008.
International Search Report issued in PCT/JP05/05100 on Jul. 5, 2005.
Japanese Office Action issued in Application No. 2004-82990 mailed Apr. 7, 2009.
English Translation of Japanese Office Action issued in Application No. 2004-82990 mailed Apr. 7, 2009.
Machine English language translation of JP 07-001077, published Jan. 6, 1995.
English Abstract of JP 07-001077 published Jan. 6, 1995.
Machine English language translation of JP 2003-170262, published Jun. 17, 2003.
English Abstract of JP 2003-170262 published Jun. 17, 2003.
Machine English language translation of JP 08-132215, published May 28, 1996.
English Abstract of JP 08-132215 published May 28, 1996.
File History of U.S. Appl. No. 12/293,556.
File History of U.S. Appl. No. 10/599,118.
File History of U.S. Appl. No. 11/565,771.
Partial File History of U.S. Appl. No. 11/565,771.

* cited by examiner

METAL MATERIAL FOR PARTS OF CASTING MACHINE, MOLTEN ALUMINUM ALLOY-CONTACT MEMBER

CROSS-REFERENCE TO RELATED APPLICATIONS

This application is a divisional of U.S. application Ser. No. 10/599,118 filed Sep. 20, 2006, now U.S. Pat. No. 7,829,138. U.S. application Ser. No. 10/599,118 claims priority to Japanese Patent Application No. 2004-082990 filed Mar. 22, 2004. Japanese Patent Application No. 2004-082990 claims priority to International Application No. PCT/JP2005/005100 filed Mar. 22, 2005. The entire contents of all of the applications mentioned above are incorporated herein by reference.

TECHNICAL FIELD

The present invention relates to a metal material for parts of a casting machine, a molten aluminum alloy-contact member and a method for producing them, and more particularly to a metal material for parts of a casting machine and a molten aluminum alloy-contact member, which have excellent melting loss resistance to a molten aluminum alloy, and a method for producing them.

BACKGROUND ART

A molten aluminum alloy has a property of reacting with a metal, such as iron, to produce an intermetallic compound. Those steel parts of a casting machine which are in direct contact with a molten aluminum alloy can be damaged due to their reaction with aluminum. This phenomenon is called melting loss. In casting of an aluminum alloy, it is essential to take measures against melting loss for chief parts, such as a conduit, a mold, a sleeve and an insert, which are to contact a molten aluminum alloy.

A steel material, such as a tool steel which has undergone a nitriding treatment, is generally used for a mold, etc. for use in aluminum casting. The nitriding treatment, which comprises diffusing nitrogen from a steel surface to form a hard nitride layer, is excellent in enhancing the wear resistance of the material. It has been pointed out, however, that such treatment is not always sufficient for preventing a melting loss.

With respect to members for which high melting loss resistance is required, it is a common practice to form a ceramic coating on the surface of a member by a vapor deposition method, such as PVD (physical vapor deposition) or CVD (chemical vapor deposition). Such a ceramic coating is known to be chemically stable to a molten aluminum alloy and exhibit very high melting loss resistance (see New Mechanical Engineering. Handbook, B2, Processing/Processing Devices, p. 157).

The biggest problem with a ceramic coating, as formed by PVD or CVD, is peeling due to a thermal stress. In particular, because of a large difference in thermal expansion coefficient between a steel base and a ceramic coating, a large thermal stress will be produced at the boundary between the ceramic coating and the steel base by the repetition of heating and cooling during successive casting cycles. The large thermal stress often causes peeling of the ceramic coating from the base, whereby the base comes into direct contact with a molten aluminum alloy. Melting of the steel base thus begins suddenly, resulting in a melting loss of the base.

For the purpose of preventing such peeling of ceramic coating, various improvements have, been made in methods for forming ceramic coatings in order to reduce the thickness of a coating, thereby minimizing a thermal stress generated at the boundary between the coating and a base, or to enhance the bonding strength between a coating and a base.

Despite the various improvements, however, the fundamental difference in thermal expansion between a ceramic coating and a steel base has been an insurmountable bar, and complete prevention of peeling of a ceramic coating has not been achieved as yet.

It is therefore an object of the present invention to solve the above problems in the prior art and provide a metal material for parts of a casting machine and a molten aluminum alloy-contact member, which have materially enhanced melting loss resistance, without resorting to conventional techniques, such as the provision of a ceramic coating by PVD or CVD.

It is another object of the present invention to provide a method for producing a molten aluminum alloy-contact member, which makes it possible to strongly bond TiC particles to a Ni alloy layer of the member so that the member has materially enhanced melting loss resistance.

DISCLOSURE OF THE INVENTION

In order to achieve the above objects, the present invention provides a metal material for machine parts for use in a casting machine for casting an article from a molten aluminum alloy, comprising a steel base, a Ni alloy layer formed on a surface of the base, and titanium carbide (TiC) bonded in a particulate state to the surface of the N alloy layer.

The present invention also provides a machine part for use in a casting machine for casting an article from a molten aluminum alloy, comprising a body, composed of a steel base and a nickel alloy layer formed on a surface of the base on the side to be in direct contact with a molten aluminum alloy, and titanium carbide (TiC) bonded in a particulate state to the surface of the Ni alloy layer.

The present invention also provides a method for producing a molten aluminum alloy-contact member for use in a casting machine for casting an article from a molten aluminum alloy, comprising the steps of: forming a Ni alloy layer on a surface of a steel base, thereby forming a body; burying the body in TiC powder; and placing the body, together with the TiC powder, in a vacuum heating oven and heating them under vacuum to a temperature at which a liquid phase generates from the Ni alloy, thereby bonding the TiC particles to the surface of the Ni alloy layer.

According to the present invention, a molten aluminum alloy-contact member, having materially enhanced melting loss resistance, can be provided without resorting to conventional techniques, such as the provision of a ceramic coating by PVD or CVD. Thus, by applying the present invention to those parts of a casting machine which are to be in direct contact with a molten aluminum alloy, the lives of the parts can be considerably extended.

BEST MODE FOR CARRYING OUT THE INVENTION

Preferred embodiments of the present invention will now be described with reference to the drawings.

Figure 1:
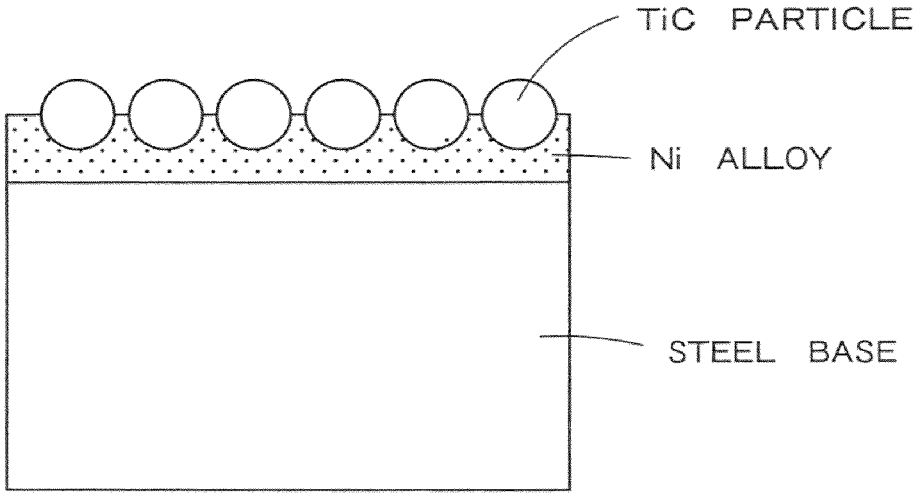
FIG. 1 is a schematic diagram showing the structure of a metal material for parts of a casting machine, according to an embodiment of the present invention.

FIG. 1 is a diagram schematically showing the structure of a metal material for parts of a casting machine, according to an embodiment of the present invention. The metal material of this embodiment comprises a steel base, a Ni alloy layer formed on the base, and titanium carbide (TiC) bonded in a particulate state to the surface of the Ni alloy layer.

TiC particles have a property of repelling a molten aluminum alloy. By utilizing this property, direct contact of a molten aluminum alloy with the steel base can be prevented and high melting Toss resistance can be achieved.

Unlike the mechanism of enhancing the melting loss resistance of a metal material by covering the entire surface with a coating to shut off contact of a molten aluminum alloy with the base metal surface, as in the conventional ceramic coating by PVD or CVD, the present metal material can be provided with materially enhanced melting loss resistance simply by densely scattering TiC particles over the base metal surface.

In the structure that the TiC is bonded in a particular state to the Ni alloy layer, a large thermal stress will not act on the TiC particles even when the base thermally expands or contracts. Thus, the TiC particles hardly peel off and, therefore, the melting loss resistance can be maintained for a long period.

The TiC particles may be partly exposed on the surface of the Ni alloy layer. This can increase the contact angle with a molten aluminum alloy, thereby enhancing the property of repelling the molten aluminum alloy.

Figure 2:
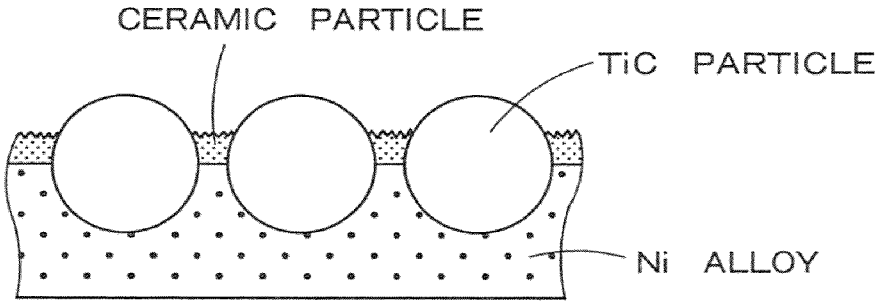
FIG. 2 is a schematic diagram showing the structure of a metal material for parts of a casting machine, according to another embodiment of the present invention.

Preferably, the gaps in the TiC particles are filled in with fine ceramic particles comprising at least one of boron nitride (BN), alumina ($Al_2O_3$) and zirconia ($ZrO_2$), as shown in FIG. 2. The fine ceramic particles improve the melting loss resistance of the underlying Ni alloy layer to which the TiC particles are bonded.

The Ni alloy preferably has the composition of 2.6 to 3.2% of B, 18 to 28% of Mo, 3.6 to 5.2% of Si and 0.05 to 0.22% of C, with the remainder being Ni and unavoidable impurities.

The TiC particles can be bonded to the Ni alloy, having the above composition, with high strength through generation of a liquid phase from the Ni alloy. Further, because of good wetting between the liquid phase and TiC particles, a large number of TiC particles can be densely bonded to the Ni alloy layer.

A conduit, a mold, a molten metal sleeve, an insert, etc. for use in a casting machine, can be typically exemplified for molten aluminum alloy-contact members or machine parts of a casting machine to which the above-described metal material is applicable.

Figure 3:
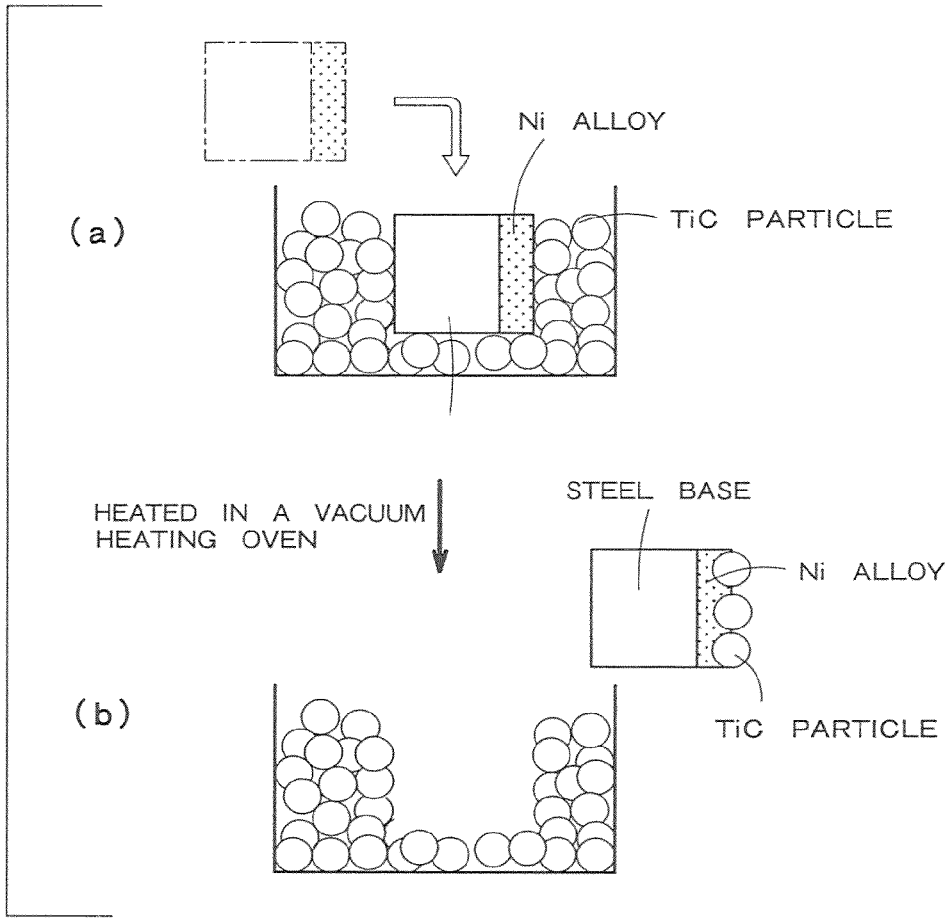
FIG. 3 is a diagram illustrating a method for producing a molten aluminum alloy-contact member according to the present invention.

FIG. 3 illustrates a method for producing a molten aluminum alloy-contact member according to an embodiment of the present invention.

The member to be produced comprises a steel base. First, a alloy layer is formed on the base by thermal spraying.

Next, as shown in FIG. 3(*a*), a vessel containing TiC powder is prepared, and the member composed of the base and the Ni alloy layer is entirely varied in the TiC powder.

The vessel, containing the TiC powder and the member buried in it, is placed in a vacuum heating oven, and heated under vacuum to a temperature at which a liquid phase is generated from the Ni alloy, thereby bonding the TiC particles to the surface of the Ni alloy layer.

By the heating, the TiC particles are bonded to the Ni alloy layer in such a state that they protrude from the surface of the Ni alloy layer, as shown in FIG. 3(*b*). In this connection, it is undesirable if the TiC particles become entirely covered with the melting Ni alloy in the heating process. In order not to entirely cover the TiC particles with the Ni alloy but to strongly bond the TiC particles to the Ni alloy layer with the particles partly exposed on the surface of the Ni alloy layer, the average particle diameter of the TiC particles is preferably made 10 to 500 μm.

When the particle diameter of the TiC particles is smaller than 10 μm, it is difficult to control the temperature during the vacuum-heating so that the TiC particles may not be entirely covered with the liquid phase of the Ni alloy. The intended melting loss resistance will not be obtained if the TiC particles are entirely covered with the liquid phase of the Ni alloy.

When the particle diameter of the TiC particles is larger than 500 μm, on the other hand, the liquid phase of the Ni alloy will cover only lower portions of the particles with small contact area and weak bonding strength. Accordingly, the particles will easily fall off.

After the bonding of TiC particles to the member, the member may optionally be subjected to a process comprising applying a slurry of a mixture of a binder and a fine ceramic powder comprising at least one of boron nitride (BN), alumina ($Al_2O_3$) and zirconia ($ZrO_2$) to the TiC particles, and burning the ceramic powder into the surface of the member. The melting loss resistance of the member increases after this process.

The Ni alloy layer, to which the TiC particles are bonded, itself has a poor melting loss resistance to a molten Al alloy. The melting loss resistance can be improved by attaching the fine ceramic powder to the Ni alloy layer. Furthermore, the attached fine powder is present such that it fills in the gaps in the TiC particles. Accordingly, the fine ceramic powder hardly falls off upon contact with a molten aluminum alloy.

EXPERIMENTAL EXAMPLES

The present invention will now be further described with reference to experimental examples.

In the examples, test specimens for melting loss test were prepared using a steel material (JIS S45C) as a base. A Ni alloy having the above-described composition was thermally sprayed onto the steel base to line the base with the Ni alloy. The Ni alloy-lined base was then buried in TiC powder in a vacuum heating oven, and heated under vacuum until the TiC particles came to be bonded to a liquid phase generated from the Ni alloy.

Two types of test specimens were prepared for Example 1 and Example 2. The specimen of Example 1 is the above specimen with the TiC particles bonded thereto but no ceramic powder attached, while the specimen of Example 2, was prepared by burning fine powder of boron nitride (BN) into the surface of the above specimen with the TiC particles bonded thereto.

For comparison with the melting loss resistances of the specimens of Examples 1 and 2, a comparative specimen was prepared by coating the same steel base as in Examples 1 and 2 with titanium nitride (TiN) by CVD.

Figure 4:
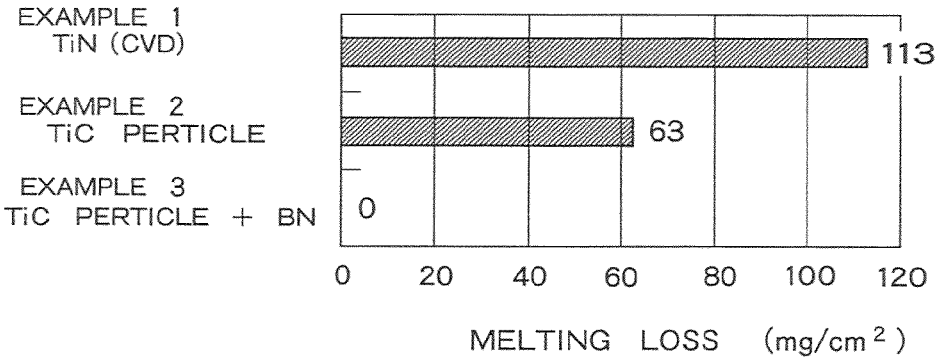
FIG. 4 is a graphical diagram showing the results of a melting loss test carried out for molten aluminum alloy-contact member specimens prepared in Examples.

A melting loss test was carried out in the following manner: Each test specimen was immersed in a molten aluminum alloy (JIS AC4C) which was kept at 720° C., and was rotated at a peripheral speed of 0.8 m/s while keeping it immersed in the molten metal for 24 hours. Thereafter, the test specimen was taken out of the molten metal, and a change in the weight of the specimen was measured. FIG. 4 is a graph showing the results of the melting loss test. In the graph of FIG. 4, the abscissa shows the amount of melting loss per unit area (mg/$cm^2$) for each of the specimens of Examples 1 and 2 and for the comparative specimen.

As is apparent from comparison of the data for the specimen of Example 1 with the data for the comparative specimen, the amount of melting loss for the specimen of Example 1, having the TiC particles bonded to the Ni alloy layer, can be reduced to approximately half of the amount of melting loss for the comparative specimen having the TiN coating formed by CVD. The data in FIG. 4 also shows no melting loss for the specimen of Example 2, having the fine BN powder filled in the gaps in the TiC particles, thus indicating superiority of the specimen of Example 2 to the specimen of Example 1.

A description will now be given of Example 3 in which a conduit, a flow passage for a molten aluminum alloy, was produced as a molten aluminum alloy-contact member.

Figure 5:
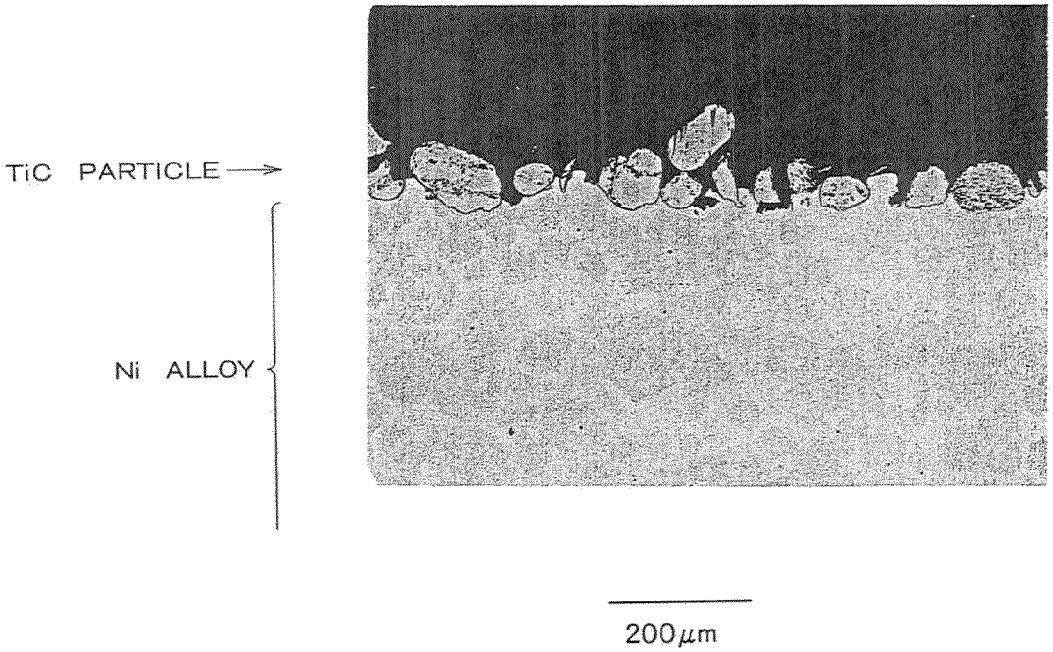
FIG. 5 is a photograph showing the structure of a molten aluminum alloy-contact member produced in Examples.

In Example 3 was used the same material as in Example 2 except for using fine alumina powder having an average particle diameter of about 1 μm instead of the fine boron nitride (BN) powder. FIG. 5 shows a photograph of a cross-section of the material of Example 3. As can be seen in the photograph, a large number of TiC particles having a size of about 100 μm are bonded to the surface of the Ni alloy layer.

For comparison with the melting loss resistance of the conduit of Example 3, a comparative conduit was produced using a material composed of the same steel base and a coating of TiN formed by CVD. A molten aluminum alloy at about 700° C. was allowed to flow in the conduit of Example 3 and in the comparative conduit, and the time elapsed before detection of a melting loss was measured.

A melting loss was detected after about 19 hours in the comparative conduit, whereas no melting loss was detected in the conduit of Example 3 even after an elapse of 100 hours.

The invention claimed is:

1. A machine part for a casting machine for casting an article from a molten aluminum alloy, comprising:

a steel base;

a Ni alloy layer formed on a surface of the base; and titanium carbide (TiC) particles densely bonded in a particulate state only to the surface of the Ni alloy layer, wherein the TiC particles are partly exposed on the surface of the Ni alloy layer and thereby yield exposed surfaces of TiC material that protrude from the Ni alloy into contact with the molten aluminum alloy utilized in casting such that a contact angle between the molten aluminum alloy and the surface is provided as a function of contact of the molten aluminum with the exposed surfaces of TiC material;

wherein a plurality of the exposed surfaces of TiC material protruding above the Ni alloy layer are provided, which repel the molten aluminum alloy;

wherein, as a function of the exposed surfaces of the TiC particles protruding from the Ni alloy layer, the contact angle between the surface and the molten aluminum alloy is increased as compared to where the TiC particles are not exposed on the surface, thereby enhancing the surface's property of repelling the molten aluminum alloy; and wherein melting loss resistance of the Ni alloy layer is enhanced by reducing contact/reaction of the Ni alloy with the molten aluminum alloy.

2. The machine part according to claim 1, wherein gaps between the TiC particles are filled in with line ceramic particles comprising at least one of boron nitride (BN), alumina ($Al_2O_3$) and zirconia ($ZrO_2$).

3. The machine part according to claim 2, wherein the Ni alloy has the composition of 2.6 to 3.2% of B, 18 to 28% of Mo, 3.6 to 5.2% of Si and 0.05 to 0.22% of C, with the remainder being Ni and impurities.

4. The machine part according to claim 1, wherein the Ni alloy has the composition of 2.6 to 3.2% of B, 18 to 28% of Mo, 3.6 to 5.2% of Si and 0.05 to 0.22% of C, with the remainder being Ni and impurities.

5. A molten aluminum alloy-contact member for a casting machine for casting an article from a molten aluminum alloy, comprising:

a body, composed of a steel base;

and a nickel alloy layer formed on a surface of the base on the side to be in direct contact with a molten aluminum alloy; and titanium carbide (TiC) particles densely bonded in a particulate state only to the surface of the Ni alloy layer, wherein the TiC particles are partly exposed on the surface of the Ni alloy layer and thereby yield exposed surfaces of TiC material that protrude from the Ni alloy into contact with the molten aluminum alloy utilized in casting such that a contact angle between the molten aluminum alloy and the surface is provided as a function of contact of the molten aluminum with the exposed surfaces of TiC material;

wherein a plurality of the exposed surfaces of TiC material protruding above the Ni alloy layer are provided, which repel the molten aluminum alloy;

wherein, as a function of the exposed surfaces of the TiC particles protruding from the Ni alloy layer, the contact angle between the surface and the molten aluminum alloy is increased, thereby enhancing the surface's property of repelling the molten aluminum alloy; and wherein melting loss resistance of the Ni alloy layer is enhanced by reducing contact/reaction of the Ni alloy with the molten aluminum alloy.

6. The molten aluminum alloy-contact member according to claim 5, wherein gaps between the TiC particles are filled in with fine ceramic particles comprising at least one of boron nitride (BN), alumina ($Al_2O_3$) and zirconia ($ZrO_2$).

7. The molten aluminum alloy-contact member according to claim 6, wherein said member is a machine part having a surface to be in direct contact with a molten aluminum alloy.

8. The molten aluminum alloy-contact member according to claim 6, wherein the Ni alloy has the composition of 2.6 to 3.2% of B, 18 to 28% of Mo, 3.6 to 5.2% of Si and 0.05 to 0.22% of C, with the remainder being Ni and impurities.

9. The molten aluminum alloy-contact member according to claim 8, wherein said member is a machine part having a surface to be in direct contact with a molten aluminum alloy.

10. The molten aluminum alloy-contact member according to claim 5, wherein the alloy has the composition of 2.6 to 3.2% of B, 18 to 28% of Mo, 3.6 to 5.2% of Si and 0.05 to 0.22% of C, with the remainder being Ni and impurities.

11. The molten aluminum alloy-contact member according to claim 5, wherein said member is a machine part having a surface to he in direct contact with a molten aluminum alloy.

12. The molten aluminum alloy-contact member according to claim 10, wherein said member is a machine part having a surface to be in direct contact with a molten aluminum alloy.

13. A molten aluminum alloy-contact member for a casting machine for casting an article from a molten aluminum alloy, comprising:

a steel base;

a Ni alloy layer formed on a surface of the base;

and titanium carbide (TiC) particles densely bonded in a particulate state only to the surface of the Ni alloy layer, wherein the TiC particles are partly exposed on the surface of the Ni alloy layer and thereby yield exposed surfaces of TiC material that protrude from the Ni alloy into contact with the molten aluminum alloy utilized in casting such that a contact angle between the molten aluminum alloy and the surface is provided as a function of contact of the molten aluminum with the exposed surfaces of TiC material;

wherein a plurality of the exposed surfaces of TiC material protruding above the Ni alloy layer are provided, which repel the molten aluminum alloy; and wherein, as a function of the exposed surfaces of the TiC particles protruding from the Ni alloy layer, the contact angle between the surface and the molten aluminum alloy is increased, thereby enhancing the surface's property of repelling the molten aluminum alloy.

14. The molten aluminum alloy-contact member according to claim 13, wherein gaps between the TiC particles are filled in with line ceramic particles comprising at least one of boron nitride (BN), alumina ($AlO_2O_3$) and zirconia ($ZrO_2$).

15. The molten aluminum alloy-contact member according to claim 13, wherein the Ni alloy has the composition of 2.6 to 3.2% of B, 18 to 28% of Mo, 3.6 to 5.2% of Si and 0.05 to 0.22% of C, with the remainder being Ni and impurities.

16. The molten aluminum alloy-contact member according to claim 13, wherein said member is a machine part having a .surface to be in direct contact with a molten aluminum alloy.

17. A machine part for a casting machine for casting an article from a molten aluminum alloy, comprising:

a steel base;

a Ni alloy layer formed on a surface of the base; and titanium carbide (TiC) particles densely bonded in a particulate state only to the surface of the Ni alloy layer, wherein the TiC particles are partly exposed on the surface of the Ni alloy layer and thereby yield exposed surfaces of TiC material that protrude from the Ni alloy into contact with the molten aluminum alloy utilized in casting such that a contact angle between the molten aluminum alloy and the surface is provided as a function of contact of the molten aluminum with the exposed surfaces of TiC material;

wherein a plurality of the exposed surfaces protruding above the Ni alloy layer are provided, characterized: (1) by a surface area of the TiC material that contacts the molten aluminum alloy and through which heat transfer occurs from the molten aluminum alloy into the TiC particles; and (2) in that contact between the molten aluminum alloy and the surface occurs at an interface where the contact angle with the molten aluminum alloy is provided by the protruding TiC material, wherein interaction of the molten aluminum alloy with the TiC material at the interface serves to repel the molten aluminum alloy; and wherein, as a function of the TiC material on the exposed surfaces of the TiC particles protruding from the Ni alloy layer, the contact angle between the surface and the molten aluminum alloy is increased as compared to where the TiC particles are not exposed on the surface, thereby enhancing the surface's property of repelling the molten aluminum alloy; and wherein melting loss resistance of the Ni alloy layer is enhanced by reducing contact/reaction of the Ni alloy with the molten aluminum.

18. The machine part according to claim 17, wherein gaps between the TiC particles are filled in with fine ceramic particles comprising at least one of boron nitride (BN), alumina ($Al_2O_3$) and zirconia ($ZrO_2$).

19. The machine part according to claim 17, wherein the Ni alloy has the composition of 2.6 to 3.2% of B, 18 to 28% Of Mo, 3.6 to 5.2% of Si and 0.05 to 0.22% of C, with the remainder being Ni and impurities.

20. The machine part according to claim 19, wherein average particle diameter of the TiC particles is between about 10 and about 500 μm.

* * * * *